United States Patent [19]

Jaffre et al.

[11] Patent Number: 4,714,041

[45] Date of Patent: Dec. 22, 1987

[54] STRUCTURE OF SURFACE EFFECT SHIP WITH SIDE WALLS

[75] Inventors: Robert Jaffre, Lorient; Yvon Ropars, Mours, both of France

[73] Assignee: Etat Francais, Paris, France

[21] Appl. No.: 849,274

[22] Filed: Apr. 8, 1986

[30] Foreign Application Priority Data

Apr. 9, 1985 [FR] France ..... 85 05311

[51] Int. Cl.[4] ..... B63B 3/32; B63B 1/32

[52] U.S. Cl. ..... 114/67 A; 114/61; 180/126

[58] Field of Search ..... 114/61, 67 A, 65 A, 114/65 R, 72, 74 A, 74 R; 180/126

[56] References Cited

U.S. PATENT DOCUMENTS 2,405,115 8/1946 Creed ..... 114/61
2,464,957 3/1949 Wood ..... 114/61
4,548,154 10/1985 Murata et al. ..... 114/74 A

FOREIGN PATENT DOCUMENTS 2422535 4/1978 France .
1210973 11/1970 United Kingdom .
1242131 8/1971 United Kingdom .
1475084 6/1977 United Kingdom ..... 180/126

*Primary Examiner*—Joseph F. Peters, Jr.
*Assistant Examiner*—Edwin L. Swinehart
*Attorney, Agent, or Firm*—Parkhurst & Oliff

[57] ABSTRACT

The present invention relates to a surface effect ship including a catamaran type supported structure with two side hulls connected by a central box structure, able to operate either as a buoyant displacement vehicle or as an air cushion supported vehicle. The ship includes, within the hulls, continuous longitudinal stiffeners mainly to bear longitudinal bending stresses within the central box structure connecting the two side hulls and built-in within these hulls, transverse beams mainly to bear transverse bending stresses, and at least two reinforced transverse bulkheads located in the bow and the stern of the ship respectively to bear transverse bending stresses applied on the bow and the stern of the ship, resulting from twist moments applied diagonally to the ship. Each bulkhead includes a transverse beam within the box structure with a vertical web and extending down within the hulls and strengthened within the box by upper and lower horizontal flanges.

10 Claims, 8 Drawing Figures

STRUCTURE OF SURFACE EFFECT SHIP WITH SIDE WALLS

BACKGROUND OF THE INVENTION

The present inention relates to surface effect ships. The present invention relates more specifically to a surface effect ship including a catamaran type supported structure with two side hulls connected by a central box structure able to operate either as a displacement vehicle or as an air cushion lifted vehicle.

Many catamaran type ships have been suggested, with two side walls connected by a central box structure, particularly for the yatching. Such multi-hull boats are attractive especially from a safety point of view as, due to the lack of ballast and dead weight, they are virtually unsinkable. On the other hand, by comparison to the mono-hull, the multi-hulls are very fast due to the lack of ballast and they are less listing and rolling due to a larger righting momentum. The multi-hull ships provide also much larger deck areas.

Surface effect ships have also been suggested, including a catamaran type structure with two side hulls connected by a central box structure aboe to operate as air cushion supported vehicle. Such ships have been described in U.S. Pat. Nos. 3,977,491; 3,987,865; 4,090,459; and also in U.K. Pat. Nos. 1,210,973 and 1,242,131.

Generally these catamaran type surface effect ships include a lifted structure with a central box structure connecting two side hulls which provide the side confinement of the lifting air cushion; on the other hand, this structure is equipped with stern and bow seals able to assist the side hulls for delimiting the lifting air cushion supplied by the pressure air generator.

As described in French patent application No. 2,422,535, other designs have been considered as catamaran type surface effect ships able to operate either as displacement vehicles or as air cushion lifted vehicles. For these, the bow and stern sealing means are equipped with a seal lifting facility allow the ship to sail as a displacement ship.

Up to now, attempts to build such catamaran type surface effect ships, particularly ships with double operation modes, have concerned only low tonnage ships.

The suggested catamaran ship structure designs, allowing a large tonnage ship to bear correctly the longitudinal bending stresses, the transverse bending stresses, and the diagonal twist stresses, have a very large weight inconsistent with a surface effect ship operation.

Further, the turbine-compressor systems generating the air cushion used by the surface effect ships suggested until now have to be very powerful due to the significant weight of these ships.

SUMMARY OF THE INVENTION

The present invention improves upon prior designs by suggesting a surface effect ship including a catamaran type supported structure with two side hulls connected by a central box structure, able to operate either as a displacement vehicle or as an air cushion lifted vehicle; this structure is equipped with longitudinal and cross bulkheads providing the subdivision and the integrity of the ship; this structure includes:

within the side hulls, continuous longitudinal stiffeners mainly to bear the longitudinal bending stresses, within the central box structure connecting said side hulls and built-in within said hulls, continuous transverse frames mainly to bear transverse bending stresses, at least on stiffened transverse bulkhead located in the bow and at least one stiffened transverse bulkhead located in the stern of the ship respectively to bear the transverse bending stresses applied on the stern and the bow of the ship resulting from diagonal twist moments on said ship, each bulkhead comprising a transverse beam within the box structure with a vertical web extending down within the hulls and strengthened within the box structure by two horizontal flanges, upper and lower respectively.

As stiffened transverse bulkheads are used to bear the transverse bending stresses applied on the bow and the stern of the ship resulting from hull twist moments, particularly in case of diagonal swell, the ship structure corresponding to this invention is very light, allowing large tonnage ships equipped with limited power systems to be built.

According to a preferred feature of this invention, the web frame of the transverse beam is stiffened horizontally.

According to the presently preferred design approach, four stiffened transverse bulkheads are located by pair in the bow and the stern of the ship respectively.

According to another advantageous feature of this invention, the area where the stiffened bulkheads transverse beam is built-in within the hulls, is itself strengthened. More specifically this built-in area is bordered by two main vertical stanchions; a stringer including a main horizontal stiffener and a main vertical stanchion is located near the stringer plate; this one provides an extra thickness, and the strengthened bulkhead within the corner area also provides an extra thickness.

Other features and advantages of the present invention will emerge when reading the detailed description below taken in conjunction with the appended figures and diagrams wherein exemplary embodiments are described.

DETAILED DESCRIPTION OF THE PREFERRED EMBODIMENTS

Figure 1:
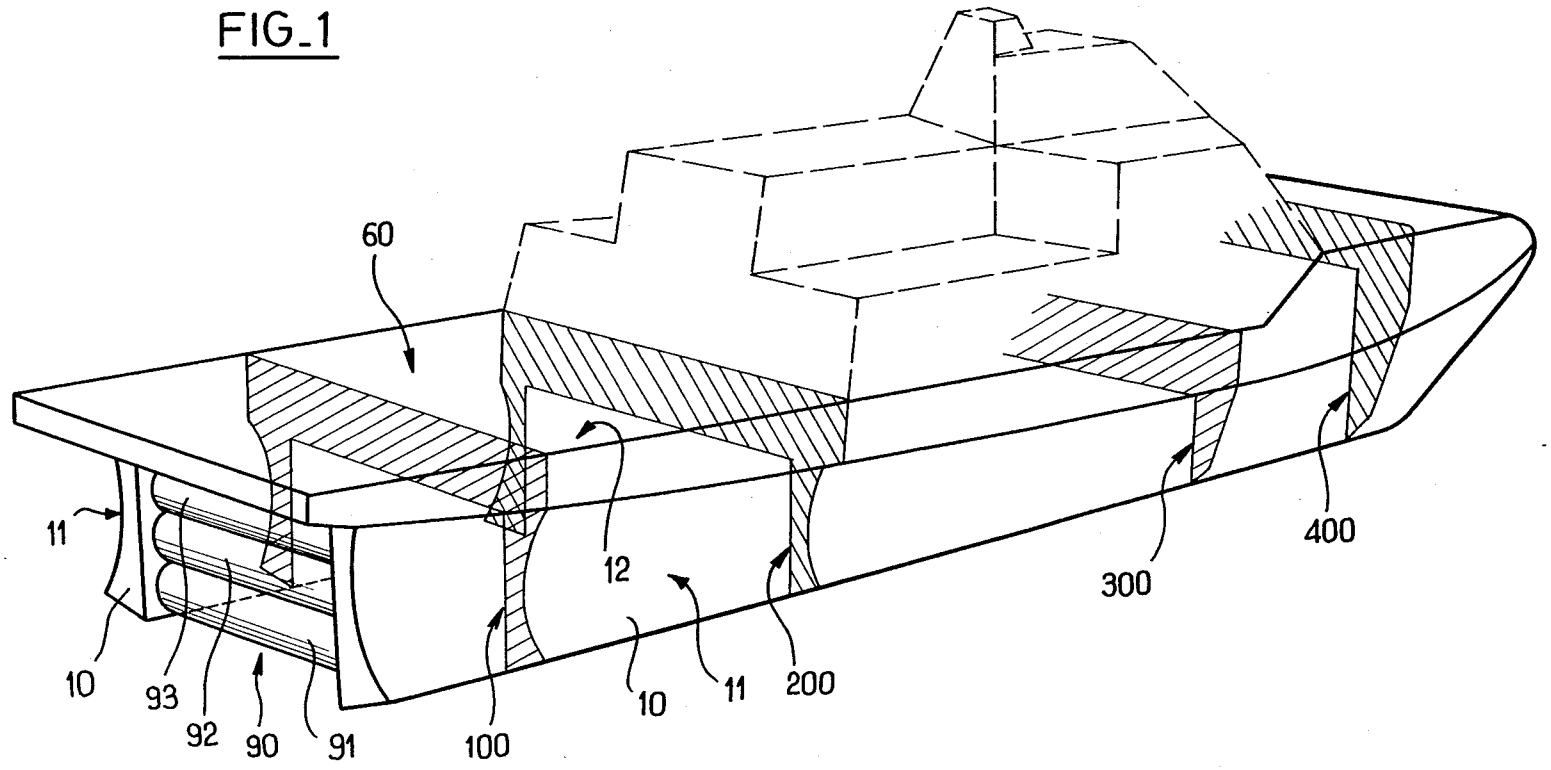
FIG. 1 shows a schematic perspective view of a surface effect ship according to the present invention.

Generally, as illustrated in FIG. 1, the surface effect ship corresponding to the present invention includes a catamaran type supported structure with two side hulls (10) connected by a central box structure.

In a conventional way, the two side hulls (10) assist the stern and bow sealing means for delimiting the lifting air cushion supplied by the pressure air generator. FIG. 1 shows the stern seal means (90) built from several superposed enclosures extending horizontally (91, 92, 93).

The bow and stern seal means are associated with raising systems (e.g. hoist and cables) allowing the ship to operate as a displacement vehicle.

On the other hand, it should be noted in FIG. 1, according to a basic specification of the present invention, four reinforced transverse bulkheads (100, 200, 300, 400) are depicted and illustrated schematically, located by pair at the stern and the bow of the ship respectively.

As previously mentioned, the hulls (10) provide the ship buoyancy and the air cushion side confinement when operating over the air cushions.

Each hull structure (10) is engineered to bear longitudinal bending moments resulting from the swell.

The side hulls are equipped with continuous longitudinal stiffeners mainly to bear the longitudinal bending stresses.

The shell plating and the deck plating include longitudinally arranged plates (11, 12).

The primary hull stiffeners are continuous and include longitudinal stiffeners (13) and deck stringers (14) to bear the longitudinal bending stresses.

Similarly, the secondary hull stiffeners are continuous and include secondary longitudinal hull stiffeners (15) and secondary longitudinal stiffeners (16) to bear longitudinal bending stresses.

In addition, the hulls (10) include bottom frames, side frames, and deck beams 17*a*.

Finally, the structure includes longitudinal and transverse bulkheads (62, 73) providing the subdivision and the integrity of the ship.

The primary and secondary frame spacing (plating and stiffeners) is designed to bear also the local stresses from the hydrostatic pressures due to the impact of the waves and from the air cushion pressure.

The central box structure (60) connects the two side hulls (10) and acts as a connecting platform between the hulls. The central box structure (60) is imbricated within the side walls (10) to insure their connection and to bear the transverse bending stresses due to the swell.

The central structure includes continuous transverse frames. The frames comprise continuous bottom transverse frame 17*a* and deck beams comprising if necessary, continuous vertical transverse cut-away plates 61.

The central box structure (60) includes also main longitudinal stiffeners 13 and deck stringers 14 and, if necessary, continuous longitudinal cut-away plates (not shown).

The structure of this central box structure resists the side thrust effects of the air cushion on the internal hulls faces (10) when operating as an air cushion lifted vehicle.

The central box structure (60) provides a built-in structure for connecting the side hulls (10) thereto in an integral fashion. This built-in structure will be described in detail later. Now it should be noted that this built-in structure includes extra thickness portions and rounded corners in order to offset the pernicious effects of structure discontinuity.

The thickness of the lower wall (65) of the central box structure (60) is engineered to bear the pressure due to the impact of waves when in the cushioning mode and also the pressure resulting from a sudden loss of lift.

Figure 2:
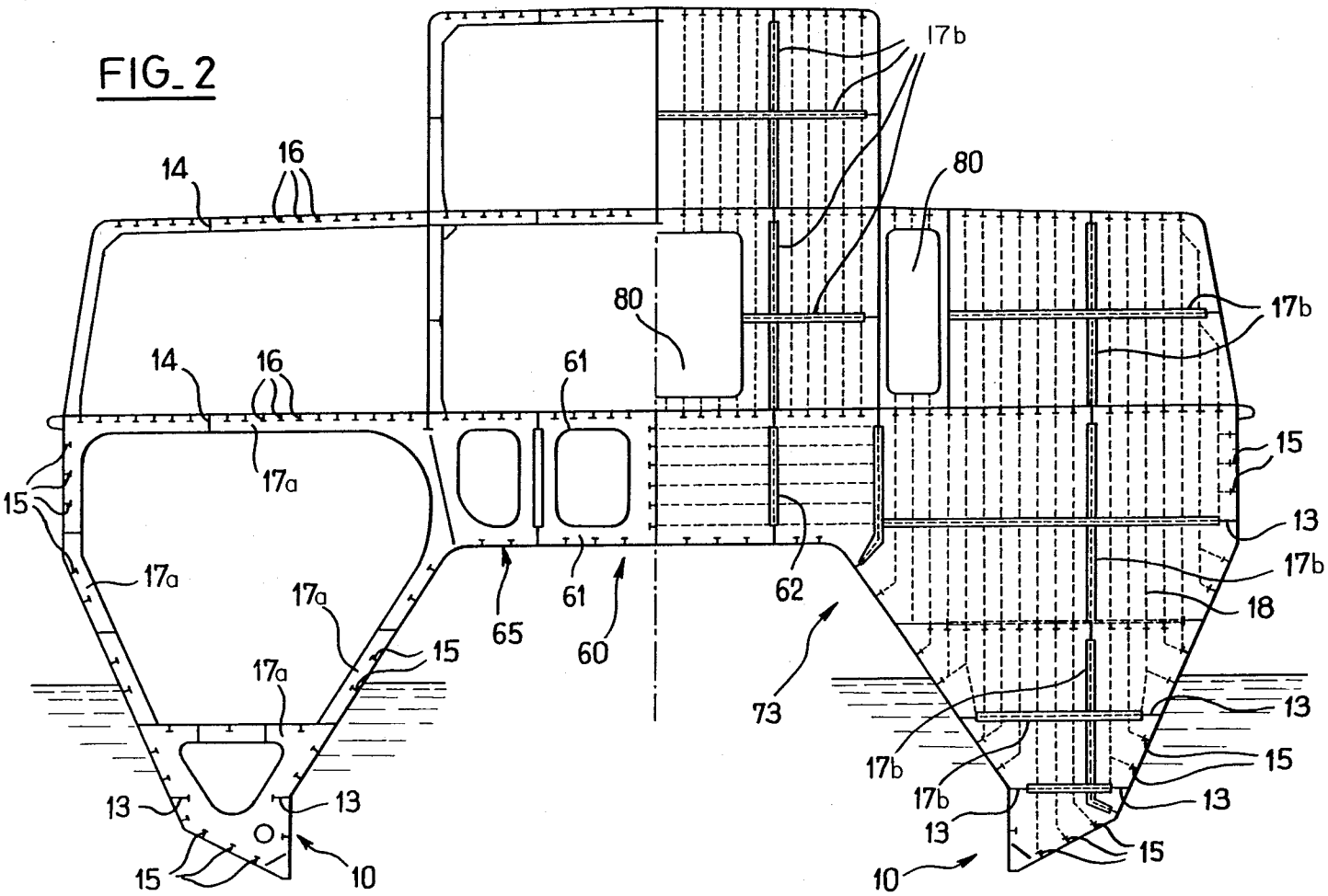
FIG. 2 shows a cross-section of this ship, at the midship frame, and shows particularly a right half view of the bulkhead and a left half view of the ship structure.
Figure 3:
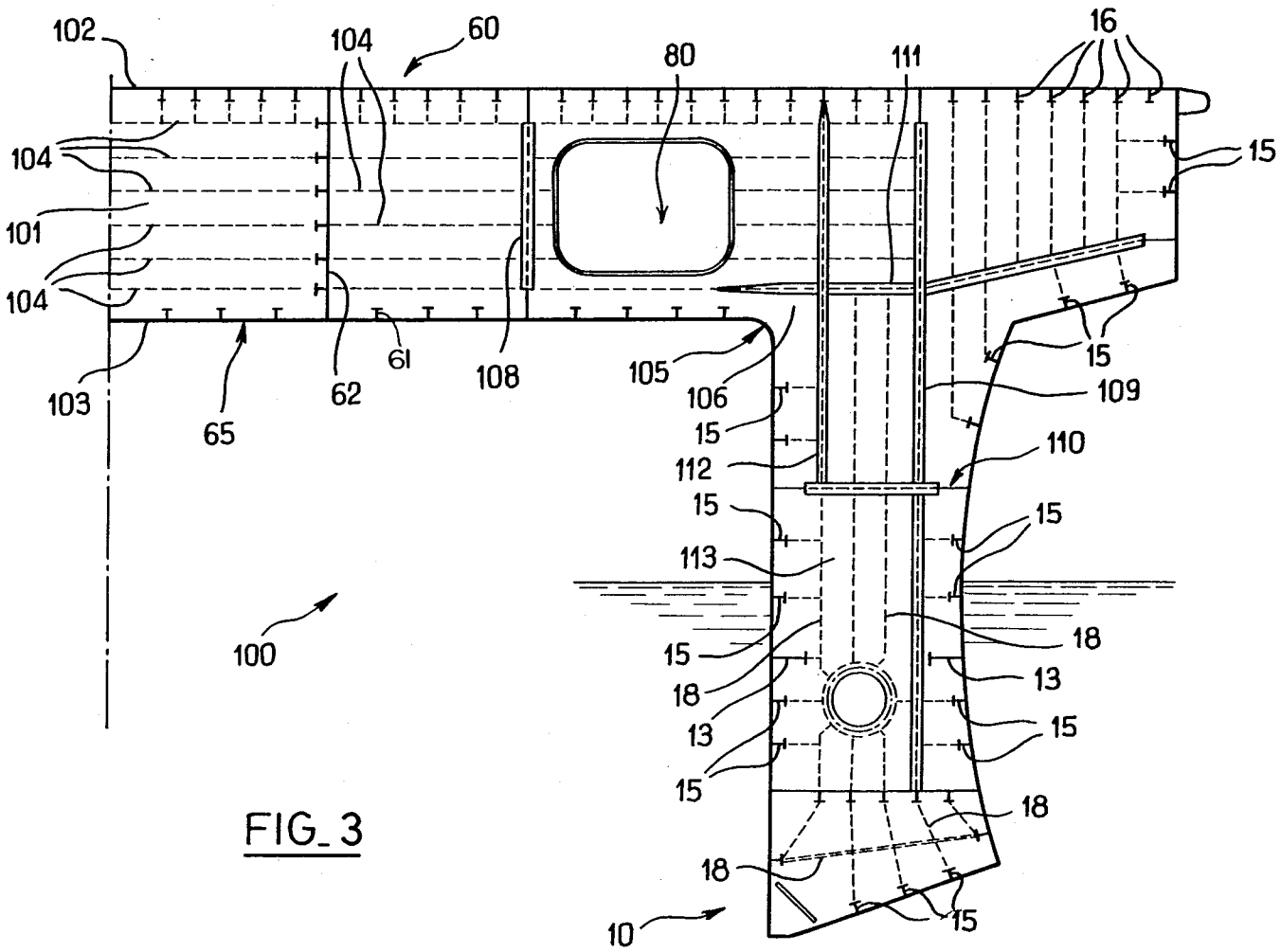
FIG. 3 shows a left half view of a reinforced transverse bulkhead in the stern part of the ship.
Figure 4:
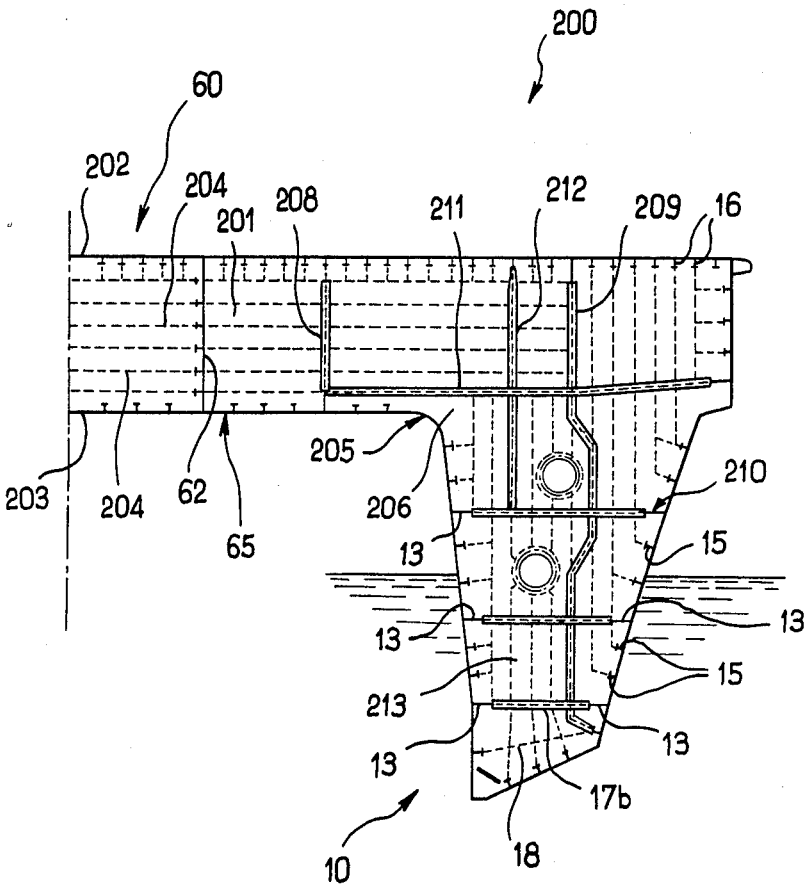
FIG. 4 shows another half side view of a second transverse bulkhead located in the stern part of the ship.
Figure 5:
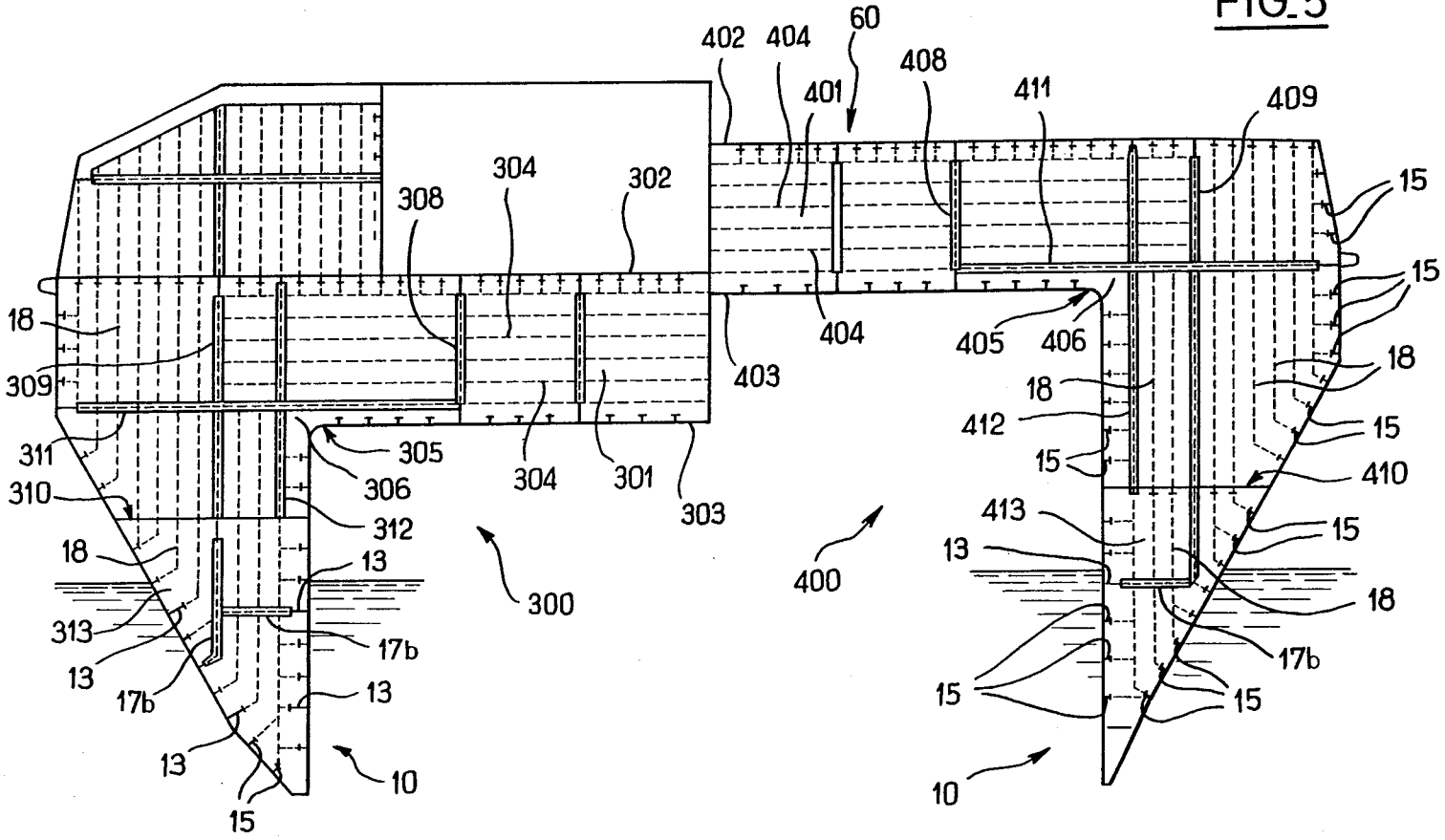
FIG. 5 shows another cross sectional view of the ship; the left half and right half views of this figure show in more detail first and second reinforced transverse bulkheads respectively located at the bow of the ship.
Figure 6:
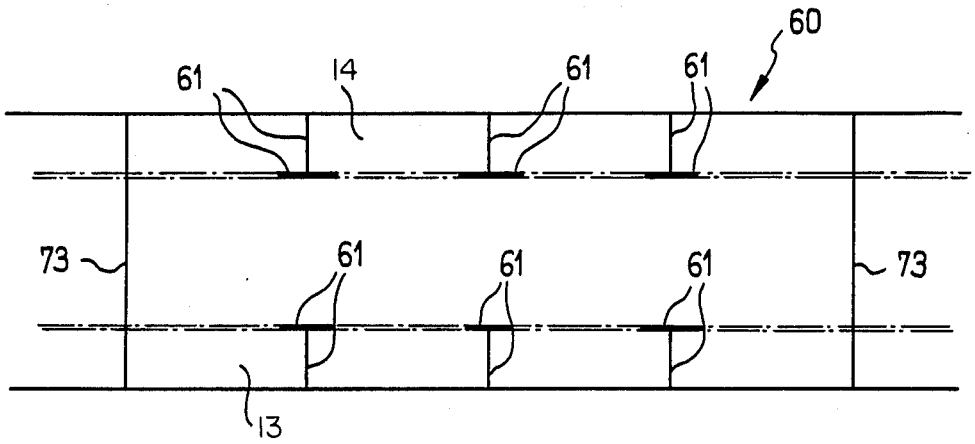
FIG. 6 shows a longitudinal cross section of the box.

The transverse watertight bulkheads provided within the side hulls (10) extend into the central box structure (60) as illustrated at (73) in the FIGS. 2 and 6. On the other hand, as also shown in FIG. 2, the stiffeners 17*b* and 18 of the bulkheads (73) within the central box structure (60) are preferably arranged horizontally to optimize the transfer of the transverse stress flow.

As previously mentioned, the present invention suggests to resist the diagonal twist stresses, not with a complex and heavy structure including for instance crossed beams, but with transverse strengthened bulkheads (100, 200, 300, 400) that bear the simple transverse bending stresses applied on the stern and the bow of the ship and resulting from twist moments imparted to the hulls especially in the case of diagonal swell.

The stiffened transverse bulkheads (100, 200, 300, 400) are located as far as possible respectively at the fore part and at the after part within the central box structure (60) and extended into the side hulls (10) as schematically illustrated in FIG. 1.

At the level of the box (60), these transverse bulkheads (100, 200, 300, 400) are formed by an I-shaped beam with a vertical web frame (101, 201, 301, 401) associated with two transverse plating strips, on the one hand 102, 202, 302, 402) and on the other hand 103, 203, 303, 403) constituting the upper and lower beam flanges respectively.

Preferably, the vertical web frame (101, 201, 301, 401) of the beams is stiffened horizontally as schematically illustrated in the figures (104, 204, 304, 404).

On the other hand, as illustrated by the figures, the previously mentioned transverse beams, strengthened to bear the shearing stresses flow are extended by also stiffened bulkheads (113, 213, 313, 413) within the side hulls (10) to transfer the transverse bending and twist stress flow resulting from the twisting effect.

The previously mentioned upper and lower flanges, on the one hand (102, 202, 302, 402) and on the other hand (103, 203, 303, 403), strengthen the transverse beams in relation to the bending stresses, and the web frame stiffeners (104, 204, 304, 404) prevent the buckling due to shearing stresses.

The structure connecting the side hulls (10) and the central box structure (60) will be now described.

The lower flange (103, 203, 303, 403) is stiffened by an extra thickness at the stringer plate level (105, 205, 305, 405) and moreover is rounded at the level of maximum stress concentration.

Figure 7:
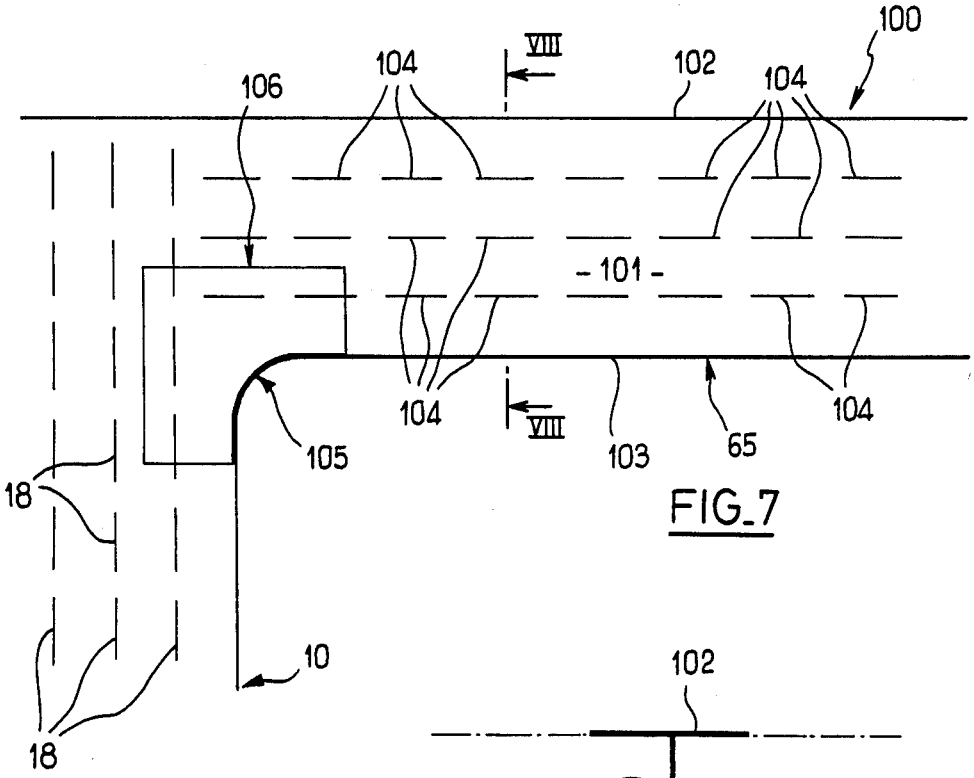
FIG. 7 shows a schematic view of the area where the box is built-in within a side hull.
Figure 8:
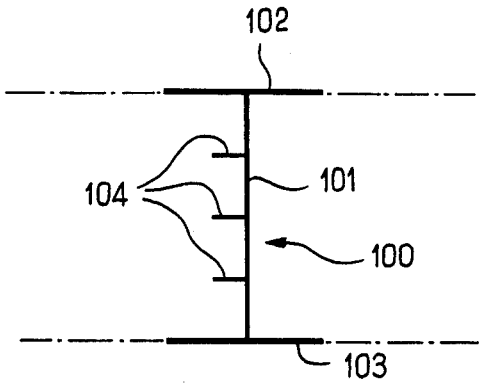
FIG. 8 shows a cross section of the transverse beam of the reinforced transverse bulkheads, taken along section VIII—VIII in FIG. 7.

As illustrated in the figures (106, 206, 306, 406) and particularly in FIG. 7, the web frame of the bulkhead transverse beams (100, 200, 300, 400) is provided with an extra thickness over a whole built-in area.

In addition, this area is bounded by two main stanchions (108, 109; 208, 209; 308, 309; 408, 409) and by an orlop deck (110, 210, 310, 410).

Finally the ship structure is strengthened as near as possible to the corner plate (105, 205, 305, 405) by a framing. This framing includes on the one hand a main horizontal stiffener (111, 211, 311, 411) and on the other hand a main vertical stanchion (112, 212, 312, 412).

The main horizontal stiffener (111-411) is located above the lower level of the central box stiffener within the side hulls (10), and it extends into the central structure box (60).

The main vertical stanchions (112-412) are located in the upper part of the side hulls (10).

The figures also show longitudinal fittings (80) provided within the structure and used for instance as air pipes for supplying the supporting air cushion, or as passageways.

According to the invention, the structure can be built with metal materials, including aluminum alloys, weldable, efficient and resistant to the marine corrosion, or with composite materials, monolithic or sandwich, very efficient, as glass fiber reinforced plastics or kevlar carbone or bore fiber reinforced plastics.

The longitudinal stiffeners provided within the side hulls to bear the longitudinal bending stresses and the transverse beams within the central box structure to bear the stresses transverse can consist of reinforcing fibers integrated within the composite material.

In such cases, the fiber reinforced composite materials being inherently anisotropic, the stiffeners should be located longitudinally within the hull to bear the longitudinal bending stresses and to provide stiffness to the whole structure, whilst they should be preferably oriented transversally within the central box structure; however these stiffeners may be locally oriented in a different way to optimize the stress flow transfer resulting from the bending and twist stresses created by the hulls.

We claim:

1. A surface effect ship including a catamaran-type supported structure with two side hulls connected by a central box structure, able to operate either as displacement vehicle or as an air cushion lifted vehicle, wherein said ship comprises:

a plurality of continuous longitudinal stiffeners with said sidewalls for bearing longitudinal bending stresses;

continuous transverse framing within said central box structure connecting said side hulls thereto and built-in within said hulls for bearing transverse bending stresses; and at least one stiffened transverse bulkhead located toward the bow and at least one stiffened transverse bulkhead located toward the stern of said ship, respectively, to bear transverse bending stresses applied on the stern and the bow of said ship resulting from diagonal twist moments on said ship, each said bulkhead comprising a transverse beam-like structure within said central box structure, said beam like structure comprising a vertical web portion strengthened within said central box structure by upper and lower horizontal flanges, said web portion extending continuously down within said hulls, each said bulkhead longitudinally subdividing the hulls and said central box structure of said ship and providing structural integrity thereto.

2. A surface effect ship as claimed in claim 1, wherein said web portion comprises horizontal stiffeners.

3. A surface effect ship as claimed in claim 2, wherein said stiffened transverse bulkheads number four, which four are located by pair toward the bow and toward the stern of said ship respectively.

4. A surface effect ship as claimed in claim 1, wherein said transverse beam-like structure of the stiffened bulkhead is built-in within said hulls, said built-in area being bordered by two main vertical stiffeners.

5. A surface effect ship as claimed in claim 1, wherein said stiffened transverse bulkheads include a framing structure proximate a corner area between said hulls and said central box structure, said framing structure comprising a main horizontal stiffener and a main vertical stiffener.

6. A surface effect ship as claimed in claim 1, wherein an extra-thickness corner plate is provided at a corner area between said hulls and said central box structure.

7. A surface effect ship as claimed in claim 6, wherein an extra thickness stiffening area is provided on said stiffened transverse bulkhead adjacent the corner plate between said hulls and said central box structure.

8. A surface effect ship as claimed in claim 1, wherein said side hulls comprise framing which is substantially longitudinal and continuous and said longitudinal stiffeners comprise main longitudinal stiffeners, deck stringers, secondary longitudinal deck stiffeners and secondary longitudinal hull stiffeners.

9. A surface effect ship as claimed in claim 8, wherein said side hulls include shell plating and deck plating arranged longitudinally.

10. A surface effect ship as claimed in claim 1, wherein said continuous transverse framing of said central box comprises a bottom transverse frame and deck beams.

* * * * *